United States Patent [19]

Helberg

[11] Patent Number: 4,778,003

[45] Date of Patent: Oct. 18, 1988

[54] HEAT EXCHANGER WITH NOVEL SEAL FOR TUBE SHEET

[75] Inventor: Gunnar I. Helberg, Lake Jackson, Tex.

[73] Assignee: The Dow Chemical Company, Midland, Mich.

[21] Appl. No.: 47,072

[22] Filed: May 5, 1987

Related U.S. Application Data

[63] Continuation-in-part of Ser. No. 455,378, Jan. 3, 1983, abandoned.

[51] Int. Cl.[4] ..... F28F 9/02

[52] U.S. Cl. ..... 165/158; 165/108

[58] Field of Search ..... 165/158, 76, 157, 108

[56] References Cited

U.S. PATENT DOCUMENTS

| | | | |
|---|---|---|---|
| 970,561 | 9/1910 | Scaramuzza | 165/158 |
| 1,410,561 | 3/1922 | Forseille | 165/159 |
| 1,842,945 | 1/1932 | Price et al. | 165/158 X |
| 2,108,076 | 2/1938 | Prickett | 165/158 X |
| 2,108,087 | 2/1938 | Thayer | 165/158 X |
| 3,494,414 | 2/1970 | Warner | 165/158 X |
| 4,279,293 | 7/1981 | Koump | 165/158 X |
| 4,557,322 | 12/1985 | Nipple | 165/158 |
| 4,595,297 | 6/1986 | Liu et al. | 165/158 X |
| 4,612,980 | 9/1986 | Roberts | 165/158 |
| 4,650,348 | 2/1987 | Roberts | 165/158 |

*Primary Examiner*—Ira S. Lazarus
*Assistant Examiner*—Richard R. Cole

[57] ABSTRACT

A novel construction of a heat exchanger such as a vertical type thermosiphon reboiler having a removable tube bundle and optional removable shell is disclosed. The inlet tube sheet is matingly, engagably secured to a ledge portion which is, in turn, secured to one flange of the shell and the opposite tube sheet is matingly, engagably secured to the opposite flange of the shell. Sealing members are more favorably located in such construction. The assembly is easily disassembled for cleaning.

2 Claims, 2 Drawing Sheets

HEAT EXCHANGER WITH NOVEL SEAL FOR TUBE SHEET

CROSS-REFERENCE TO RELATED APPLICATIONS

This is a continuation-in-part of application Ser. No. 455,378, filed Jan. 3, 1983, now abandoned.

BACKGROUND OF THE INVENTION

This invention relates to a heat exchanger with a novel seal means for at least one tube sheet of the tube bundle in said heat exchanger. The seal means construction for the tube sheet of the heat exchanger, permits one to easily disassemble the heat exchanger and easily remove the tube bundle with the tube sheets as a singly unit to facilitate cleaning both the exterior and interior of the tube bundle as well as the shell interior surfaces.

There are various types of heat exchangers used in a horizontal or vertical position for different processes known in the art. For example, in a process for heating a liquid circulating in a distillation column, a reboiler type heat exchanger is used.

Conventional reboilers are usually horizontal, kettle-type reboilers employing a removable "U" type tube bundle. This configuration of reboiler has the disadvantage of being unstable in maintaining a constant liquid head. A constant liquid head is essential to efficient circulation and heat transfer. Another disadvantage of the "U" type tube bundle, horizontal reboiler is that a "U" tube bundle is difficult to clean, especially if the bundle is in fouling service.

A vertical type thermosyphon exchanger is more economical, efficient, and easily operative and maintained when needed to reboil, for example, the bottoms liquid on a conventional fractionating column.

Vertical thermosyphon reboilers are generally fixed tube type reboilers. The fixed tube characteristic of the reboiler precludes the reboiler's use in sensible heat transfer when the heating (shell side) medium is of a fouling nature requiring removal of the tube bundle for cleaning.

A vertical reboiler containing a conventional floating head bundle in the vertical position cannot effectively seal the shell side materials from the tube side materials and cross contamination of the two streams is inevitable. The use of a conventional lantern ring type of exchanger is limited by the materials of construction of the lantern ring and the effectiveness of the seal ring.

Since the tube bundle must not only be cleaned on the tube side by the usual means such as "hydroblasting", it must also be able to be removed from its shell without causing bundle distortion so that the shell side can be cleaned. Distortion affects the flatness of the flanged mating surfaces of the shell, bundle and heads.

It is desired to circumvent the problems of the prior art reboilers by providing a heat exchanger, preferably of the vertical type with a novel seal means for at least one of the tube sheets which prevents leakage between the shell and tube side contents. It is also desired to provide a heat exchanger that can be easily disassembled for cleaning and repair.

SUMMARY OF THE INVENTION

This invention is directed to a heat exchanger comprising:

(a) a housing consisting of an open-ended shell member with a first and second flange member on each end of the shell member;

(b) a removable tube bundle disposed within said housing; said bundle including a first and second spaced tube sheets and heat exchange tube therebetween;

(c) cover members for closing the shell member ends; said covering members with mating peripheral flanges for fixedly and removably mounting to the first and second shell flanges, respectively;

(d) means for fixedly and removably sealing the first and second tube sheets to the peripheral flanges of the cover members; and (e) a ledge portion in fixedly, sealably and removably contact with at least one of the tube sheets.

DETAILED DESCRIPTION OF THE PREFERRED EMBODIMENTS

While the heat exchanger of the present invention can be used in the horizontal position, it is preferred to use the heat exchanger in processes where it is to be positioned in the vertical configuration. Therefore, the present invention will be described with reference to a vertical tube bundle and a vertical shell. More preferably, the present invention will be described with reference to a vertical shell-and-tube type thermosyphon reboiler 10 shown in FIG. 1.

Figure 1:
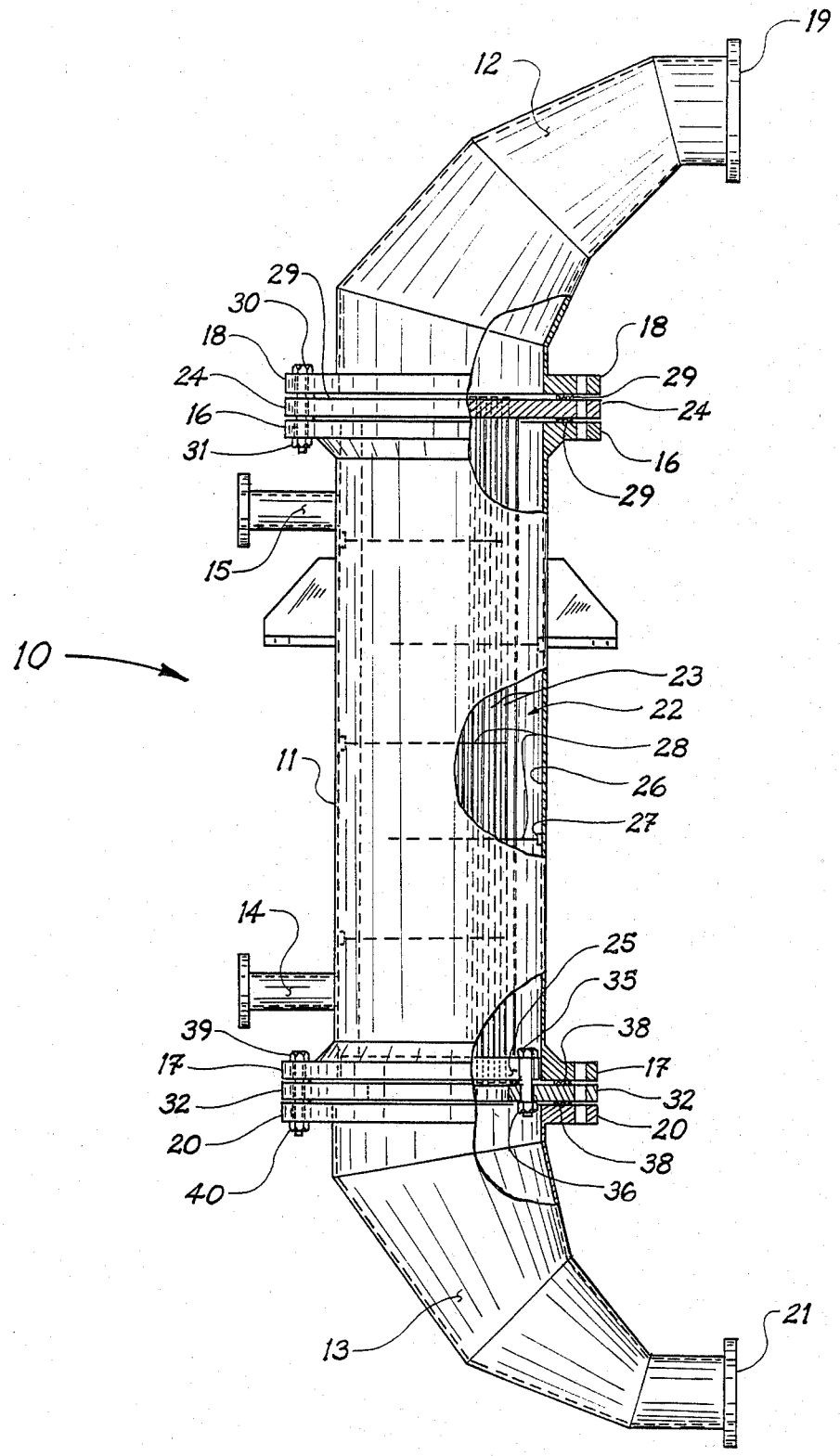
FIG. 1 represents an elevation in partial cross section of a vertical side arm thermosyphon reboiler for a distillation column.
Figure 3:
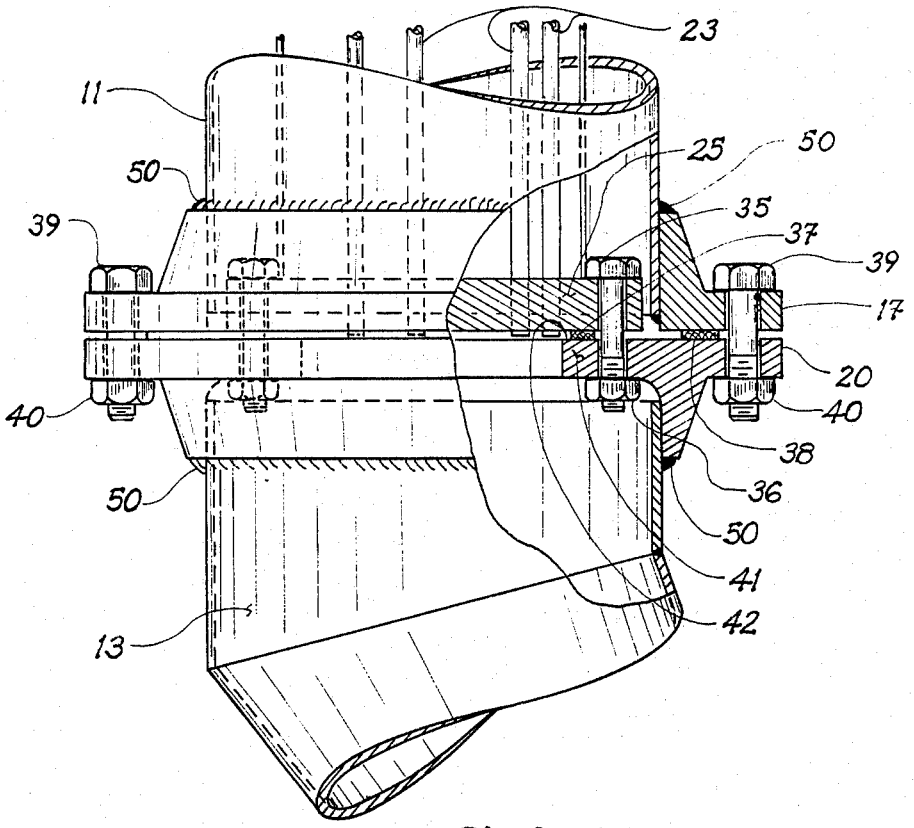
FIG. 3 illustrates another embodiment of the sheet assembly at the inlet end of the tube bundle. tube bundle inlet end shell flange-tube sheet configuration in accordance with the present invention.
Figure 2:
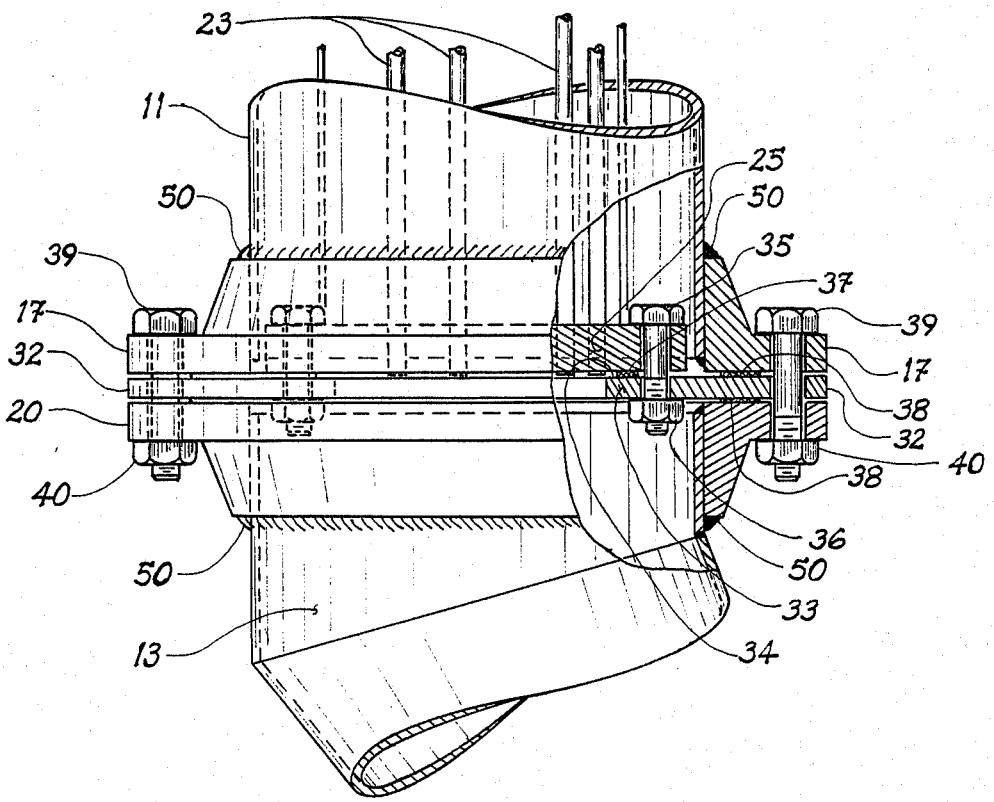
FIG. 2 represents in partial cross section one embodiment of the shell flange-tube bundle tube

With particular reference to FIGS. 1–3, the preferred vertical shell-and-tube thermosiphon reboiler 10 comprises a shell member 11 interposed between two transition members 12 and 13. In the vertical reboiler, one transition member forms a top cover for the shell and the other transition member 13 forms the bottom cover for the shell. The top and bottom cover members 12 and 13 are in direct fluid communication with process equipment, for example, a distillation column (not shown). Generally, the bottom cover member 13 forms an inlet side to the heat exchanger tube bundle and the top cover member forms an outlet side to the heat exchanger tube bundle, for example, for recirculating fluid to the vapor zone above the liquid level within the distillation column. The cover members 12 and 13, in this instance, are generally in the shape of an elbow or curvical in shape. The shell member 11 also contains an inlet 14 and an outlet 15 for passing a fluid, such as a heating medium, from a source point or other process equipment (not shown) through the shell side of the reboiler 10. Each of the members 11, 12 and 13 are provided with mating, engaging, sealable peripheral flanges 16–21 to facilitate the assembly of the members 11, 12 and 13 in fluid-tight sequence. The shell member 11 contains a first peripheral flange member 16, herein referred to as the top shell flange 16, integral therewith. The shell member 11 also contains a second peripheral flange member 17, herein referred to as the bottom shell flange 17, integral therewith.

The top cover member (top elbow) 12 contains a first peripheral flange member 18 for engaging the top shell flange 16. The top elbow 12 also contains a second peripheral flange member 19 for engaging, in fluid communication, process equipment (not shown).

The bottom cover member (bottom elbow) 13 contains a first peripheral flange member 20 for engaging the bottom shell flange 17. The bottom elbow 13 also contains a second peripheral flange member 21 for engaging, in fluid communication, process equipment (not shown).

The tube bundle, generally indicated by numeral 22 comprises a plurality of heat exchange tubes 23 seated (swagged) into a pair of spaced apart tube sheets—a first tube sheet 24 and a second tube sheet 25, respectively. The tubes 23 extend from near the top shell flange 16 to near the bottom shell flange 17. The first tube sheet 24, herein referred to as the top tube sheet 24, is of a larger diameter than the second tube sheet 25, herein referred to as the bottom tube sheet 25. The lesser diameter bottom tube sheet 25 is in fact slidably removable from the shell 11 and, therefore, being lesser diameter than the interior wall 26 of the shell 11, including any interior projections or seals 27 for the baffles 28 indicated as longitudinally spaced in transverse configuration to and surrounding the tubes 23 of the tube bundle 22.

The top tube sheet 24 is interposed between the top shell flange 16 and the first flange member 18 of the elbow member 12. Seal members 29, such as flat annular gaskets, are interposed between the top tube sheet 24 and the top shell flange 16 and between the tube sheet 24 and the first flange 18 of the elbow member 12 to provide a fluid-tight seal and isolate the fluid passing exterior to the tube bundle 22 from the fluid passing interior to the tubes 23 of the bundle 22. The flange members 16 and 18 with the tube sheet 24 are removably attached together, for example, with a plurality of bolts 30 and nuts 31.

In FIG. 1, and more better illustrated in FIG. 2, there is shown the bottom tube sheet 25 connected to the bottom elbow member 13 in a sealing relationship. A washer-like peripheral plate member 32 is interposed between the bottom shell flange 17 and the first flange member 20 of the bottom elbow member 13. The plate member 32 radially extends a predetermined length toward the center axis of the shell member 11 forming a flat ledge portion 33 with a shoulder 34 for supporting the bottom tube sheet 25 and providing a mating surface for a seal member 37. The bottom tube sheet 25 is removably attached to the ledge portion 33, for example, with a plurality of bolts 35 and nuts 36. The seal member 37, such as an annular flat gasket, is provided betwen the tube sheet 25 and the ledge portion 33 to provide a fluid-tight seal therebetween. Seal members 38, such as annular flat gaskets, are provided on side of the plate 32 to provide a fluid-tight seal and to isolate the fluid in the shell side from the fluid in the tube side of the heat exchanger. The flange members 17 and 20 with the plate 32 are removably attached together, for example, with a plurality of bolts 39 and nuts 40. The flange members 17 and 20 attached to the shell and elbow member, 11 and 13 respectively, for example, by welding at points 50.

With reference to FIG. 3, there is shown another embodiment of the sealing mechanism for the tube bundle 22 and the bottom elbow member 13. FIG. 3 shows a bottom elbow member 13 having a first flange member 20 extending a predetermined length radially toward the center axis of the shell member 11 forming a flat ledge portion 41 with a shoulder 42 for supporting the bottom tube sheet 25 and for providing a mating surface for a seal member 37. In this instance, the bottom tube sheet 25 is removably attached to the ledge portion 41, for example, with a plurality of bolts 35 and nuts 36. The seal member 37, such as an annular flat gasket, is provided between the tube sheet 25 and the ledge portion 41 to provide a fluid-tight seal therebetween. A seal member 38, such as an annular flat gasket, is provided between the bottom shell flange 17 and the first flange member 20 of the bottom elbow 13 to provide a fluid-tight seal and to isolate the fluid in the shell side from the fluid in the tube side of the heat exchanger. The flange members 17 and 20 are removably attached together, for example, with a plurality of bolts 39 and nuts 40. The flange members 17 and 20 are attached to the shell and elbow member, 11 and 13 respectively, for example, by welding at points 50.

Although not shown in any figures herein, the construction of the present invention may also incorporate any number of short removable flanged sections to make up the elbow member 13 to enable interior bolts 35 and nuts 36 to be drawn snug to effectuate the seals of the bottom tube sheet 25 to the flange 20.

As aforementioned, the tube bundle tube sheets 24 and 25 are matingly engagable and sealable onto and into respective flanges of the heat exchanger. Such a construction permits ready disassembly and removal of the tube bundle and tube sheets as a single unit to facilitate cleaning both the exterior and interior of the tube bundle as well as the shell interior surfaces. Such a construction further permits the shell and tube assembly to be disassembled as a unit from the shell for ready repair.

It is preferred to add stiffeners to the tube bundle longitudinal to the tubes. Baffles may be located along the tube bundle length and in such a configuration a shell interior wall seal will be a necessary part of the tube bundle assembly. Such seal may consist of a metal plate normal to the baffle having substantial mating and sealable configuration to the interior surface of the shell throughout the circumference of said baffle, or the baffle plate may be a snug thermal expansion fit upon the unit being raised to operating temperature.

The sealing means used in the present invention depend on the nature of the fluids being passed through the tubes and shell and may vary from application to application. For example, the seal may be a recessed circular seal or of a flat gasket configuration. The materials of the seal member may be for example rubber, PTFE, metal or asbestos.

Other modifications will become apparent to those skilled in the art to which the present invention pertains.

The heat exchanger described above can be used as a vertical thermosyphon reboiler as shown in FIG. 1. Generally speaking, the reboiler can use the heat from a stream emanating from the bottom of, for example, a stripper column which flows within the shell of the reboiler counter currently to the tube side flow emanating from the sump of another column, for example of a distillation column, to which the reboiler is physically attached.

The heat provided from the bottom stream of the stripper column is cross exchanged to the stream circulating from the column sump, through the tubes of the reboiler. The tube side liquid is heated to boiling to such degree to cause vaporization of the circulating liquid, thereby providing the driving force required to fractionate a liquid mixture within the column.

The utilization of a hot-stripped solvent as a heating medium eliminates, for example, the use of steam which was previously used as a heating medium for the conventional type steam reboilers which the present invention replaces.

In addition, using the reboiler of the present invention, provides the heating medium solvent stream to leave the shell side of the reboiler at a lower temperature. This provides the advantage of saving energy by lowering the air or water cooling requirements to reach the necessary solvent feed temperature.

What is claimed is:

1. A thermosiphon reboiler heat exchanger comprising:

(a) a housing vertically disposed consisting of an open-ended shell member with a top and bottom flange member;

(b) a removable tube bundle diposed within said housing; said bundle including top and bottom spaced tube sheets and heat exchange tubes therebetween;

(c) top and bottom cover members for closing the shell member ends; said cover members with peripheral flanges for fixedly and removably mounting to the top and bottom shell flanges, respectively;

(d) means for fixedly and removably sealing the top and bottom tube sheets to the peripheral flanges of the cover members;

(e) a separate washer-like peripheral shelf plate member interposed between the bottom shell flange and the flange member of the bottom cover member; said plate member forming a flat ledge portion in fixedly, sealably and removably contact with the bottom tube sheet and adapted for supporting the bottom tube sheet and providing a mating surface for a seal member; and (f) a seal member interposed between the bottom tube sheet and the ledge for providing a fluid-tight seal therebetween, wherein said thermosiphon reboiler utilizes a hot-stripped solvent as a heating medium.

2. The exchanger of claim 1 wherein the plate member is sealably fixed to the bottom tube sheet with nuts and bolts.

* * * * *